US005113891A

United States Patent [19]

Carney

[11] Patent Number: 5,113,891

[45] Date of Patent: May 19, 1992

[54] WATER FREEZE GUARD VALVE

[76] Inventor: Frederick P. Carney, 2006 E. Highland Dr., Hurricane, W. Va. 25526

[21] Appl. No.: 786,010

[22] Filed: Oct. 31, 1991

[51] Int. Cl.[5] ..... F16K 31/64; E03B 7/12

[52] U.S. Cl. ..... 137/60; 137/80; 138/27; 138/32; 237/80; 251/66; 251/297

[58] Field of Search ..... 137/59, 60, 61, 62, 137/79, 80, 456, 457; 138/27, 32, 34; 237/80; 251/66, 67, 297; 74/527

[56] References Cited

U.S. PATENT DOCUMENTS

| | | | |
|---|---|---|---|
| 1,971,459 | 8/1934 | McGuire | 137/60 |
| 2,733,729 | 2/1956 | Wolfe | 251/297 |
| 3,369,556 | 2/1968 | Allderdice | 137/62 |
| 3,380,464 | 4/1968 | Arterbury et al. | 137/60 |
| 3,790,129 | 2/1974 | Pauls | 251/297 |
| 4,079,660 | 3/1978 | Ives | 251/297 |
| 4,260,132 | 4/1981 | Habiger | 251/297 |
| 4,313,452 | 2/1982 | Mellard | 137/62 |
| 4,361,167 | 11/1982 | Harasewych | 137/62 |
| 4,438,777 | 3/1984 | Pirkle | 137/62 |
| 4,784,173 | 11/1988 | Carney | 137/2 |
| 4,815,491 | 3/1989 | Pirkle | 137/60 |
| 4,844,412 | 7/1989 | Kubozono | 251/297 |
| 4,848,389 | 7/1989 | Pirkle | 137/80 |

FOREIGN PATENT DOCUMENTS

| | | | |
|---|---|---|---|
| 247953 | 1/1948 | Switzerland | 137/60 |

*Primary Examiner*—George L. Walton
*Attorney, Agent, or Firm*—Marion P. Lelong

[57] ABSTRACT

A water freeze guard valve having a water-filled actuator chamber and a linkage assembly for transmitting linear expansion movement, caused by ice formation within the actuator chamber, to force a poppet disc against the seat of the valve supply port and thereby close the valve when freezing conditions occur, a latch assembly for keeping the valve open prior to freezing weather, a spring to keep the valve closed during the subsequent thaw, and a lever for manually and selectively re-opening the valve. When installed in a water supply line for a building structure that is subject to freezing and thawing conditions, the valve shuts off the supply of water to the building structure during the freeze and prevents further supply of water to the building after the thaw occurs so that the interior of the building is not damaged by flooding.

19 Claims, 7 Drawing Sheets

WATER FREEZE GUARD VALVE

BACKGROUND OF THE INVENTION

1. Field of the Invention

This invention relates to devices for protection against the aftermath of frozen water supply systems and particularly to devices for preventing water damage to buildings after frozen water pipes have thawed. It specifically relates to devices for automatically closing water supply lines when freezing conditions occur and keeping them closed during the subsequent thaw.

2. Review of the Prior Art

Power failures during blizzards in northerly climates can cause severe freezing damage to pipes, in spite of good insulation, and devastating water damage to the interiors of unoccupied homes, commercial buildings, and industrial plants during a subsequent thaw. In addition, freezing of water in pipes, causing rupture of the pipes and subsequent damage to buildings by escaping water, is a common difficulty in areas of the world where severe freezing is sufficiently infrequent that plumbing design does not include complete thermal protection.

Devices that depend upon the expansion of water or another substance during freezing thereof, to cause bleeding of water from the system and consequent prevention of freezing within pipes of the system, include U.S. Pat. No. 4,313,452 of Mellard, U.S. Pat. No. 4,784,173 of Carney, and U.S. Pat. No. 4,848,389 of Pirkle. If such bleeding devices fail or if they are not installed, as is commonly the situation in vacation homes, a close-off device is badly needed to shut off the supply of water at the onset of a freeze or at least at the onset of a thaw.

A valve device that shuts off water flow from a main to a water system within a building at the onset of a freeze must be maintained in its closed position during the thaw as well as during the freeze. Valve devices having a latch means for retention of the closure position include U.S. Pat. No. 4,438,777 of Pirkle and U.S. Pat. No. 4,844,412 of Kubozono. The former utilizes wax as its temperature detection medium and is designed for use with locomotives. The latter is designed for oil-filled hydraulic systems and is not directed to the problem of freezing and thawing of water systems.

There is accordingly a need for a failure-safe freeze shutoff or guard valve for homes, commercial buildings, and industrial plants that is automatically operable during freezing weather without manual or electrical operation thereof and that remains in its shutoff position during the subsequent thaw until selectively opened.

SUMMARY OF THE INVENTION

It is therefore an object of this invention to provide a device which furnishes completely dependable protection against water damage caused by a thaw after a freeze.

It is another object to provide a water freeze guard or prevention device which is automatically responsive to ambient temperatures that are at and below the freezing temperature of water.

It is still another object to provide a water freeze guard or prevention device which does not require venting of air during operation thereof.

It is a further object to provide a water freeze guard or prevention device that derives its motive force entirely from the freezing of water within the device.

It is still further object to provide a water freeze guard or prevention device that is not subject to failure because of failure of o-rings, seals, or threaded connections.

In accordance with these objects and the principles of this invention, it has surprisingly been discovered that the freezing of water can be utilized as the sole source of power for closing a guard valve which is line-connected to a water supply system, such as a water supply system for a home, a public or commercial building, or an industrial plant where water damage can be severe, that this closed position can be retained with a biasing means, that a lever means can be provided for selective opening of the valve, and that a latch means can be provided to maintain the valve in open position prior to the onset of freezing weather.

This invention utilizes the volumetric expansion of water while it freezes in a water-filled actuation chamber which is elongated, disposed approximately vertically, and operably connected to a linkage means for transmitting expansion of the freezing water to a valve poppet controlling a supply port to a water system that is herein defined as a water or aqueous solution supply system of pipes, valves, and the like or a water heating system comprising a water heating device, circulating pumps, pipes, valves, and the like.

The invention more specifically comprises an actuator for a temperature-responsive valve, comprising a valve body having a water inlet, a water outlet, a valve port surrounded by a valve seat, an actuator opening, and a stem bore, the valve being connected to a water supply system which is exposed to a freezing ambient environment, comprising:

A. an actuator housing which encloses an elongated chamber having a closed end, an open end, and a central axis, this chamber being filled with water and in flow communication with the water system;

B. at least one segment of an expansion sensing means which is disposed within the chamber;

C. a linkage means for axially transmitting movement of the expansion sensing means to a poppet disc for engaging the valve seat when freezing of the water within the chamber initially forms a seal between the housing and the least one segment and then causes the distance between the segment and the closed end to increase;

D. a latch means for maintaining the poppet disc spaced apart from the valve seat during normal operation of the water system;

E. a biasing means for maintaining the poppet disc in contact with the valve seat after freezing has occurred within the actuator housing; and F. a lever means for selectively actuating the latch means after freezing and a subsequent thaw have occurred.

Broadly defined, the expansion sensing means comprises at least one such segment, and preferably two or more, such as four to eight segments, each comprising a transverse portion having a periphery which is approximately adjacent to the inner surface of the wall of the chamber and a longitudinal portion which spaces the segments apart and provides expansion space in parallel to the wall.

Most preferably, the chamber is cylindrical, and the segments are sensing balls which fit closely but movably within the chamber. The segments may also be shaped as truncated double cones and be aligned within the chamber so that ends of the cones are in abutting relationship and substantially coincide with the central axis of the chamber. As another embodiment, each segment may comprise a disk and an axially aligned rod.

The linkage means comprises:

A. a poppet latchpin, comprising:

1) an actuator rod which is axially aligned with the housing and in firm contact at one end with the surface of the uppermost segment,
2) a frusto-conical cam which is axially aligned with and attached to the rod,
3) a cylindrical detent groove which is axially aligned with and attached to the cam and is bordered by lower and upper cam shoulders,
4) a guide rod which is axially aligned with and attached to the upper cam shoulder,
5) a poppet disc which is axially aligned with and attached to the guide rod and has a deformable surface which engages the valve seat,
6) a poppet stem which is axially aligned with and attached to the disc, and
7) an o-ring which is mounted in sealing relationship around the stem;

B. a poppet compression spring which is disposed around the actuator rod; and

C. a poppet stem which is attached at one end to the poppet disc and is disposed so that it is axially movable within the valve seat and has sufficient length that its other end projects through the stem bore and beyond the valve body.

The latch means, for keeping the supply port open while temperatures are above freezing, comprises:

A. a latch housing which is attached to the actuator housing and to the valve body;

B. a plurality of radially disposed and equilaterally spaced bores in the housing;

C. a plurality of latch compression springs which are disposed within the bores; and D. a plurality of latch balls which are disposed at the inward ends of the latch springs and press against the cylindrical detent groove while the supply port is open and against the frusto-conical cone while the supply port is closed.

The poppet latchpin, the balls, and the springs are formed from stainless steel in order to minimize corrosion. All other housing components are brass.

Expansion of the water to form ice within the chamber causes axial movement of the rod, without destroying the ice seal between the periphery of each segment and the wall. This rod movement engages the poppet disc with the valve seat and prevents passage of water to the water supply system.

The invention may also be defined as a device for protecting building interiors from water damage during a thaw after freezing weather, by utilizing the longitudinally directed expansion of water accompanying ice formation during the freezing weather to close a water supply valve to a water supply system for the building interiors, comprising:

A. a vertically disposed, elongated housing which encloses an actuator chamber containing a means, at the freezing point of water, for sensing the expansion of water stored therein as the water becomes ice;

B. a circumferentially disposed latch means, attached to the housing and to the body of the valve, for maintaining the poppet disc at a selected distance below the supply port while the water remains in its liquid state;

C. a linkage means for transmitting this expansion upwardly toward the water supply valve, comprising a poppet latchpin which comprises:

1) a poppet disc which sealingly engages the valve seat of the supply port in the water supply valve when this expansion occurs,
2) an upper biasing means for pressing the poppet disc against the valve seat after freezing of the water in the chamber has disengaged the latch means, and
3) a cam means for assisting the upper biasing means after freezing of the water in the chamber has forced the latch means into contact with the cam means; and D. a lower biasing means for compressing the sensing means against the linkage means.

The expansion sensing means preferably comprises a plurality of segments which incrementally form a plurality of ice seals and sense the expansion of the water at the freezing temperatures. Heat from the valve moves toward the closed end of the actuator through the wall of the housing, the actuator rod, the segments, and the water within the chamber while heat is moving outwardly through the wall and the bottom end of the housing. Freezing conditions are consequently maintained within the chamber up to a heat balance zone where heat inflow balances heat outflow. If this zone is below the periphery of the lowest segment, the actuator will not operate because an ice seal cannot form. If always above the lowest segment, the actuator will operate with only one segment. However, a plurality of segments provides flexibility and more rapid action for the actuator. The valve body additionally comprises:

A. an elongated top port, having male threads and a stem bore which is in axial alignment with the actuator;

B. an upwardly extending lug arm which is attached to a top cap that fits over the top port;

C. a fastening nut which engages the male threads and holds the top cap in a selected position; and D. a lever arm which is pivotally attached to the lug arm so that it is capable of pressing against the top of the poppet stem after freezing and thawing of water within the chamber have occurred, whereby the latch means is again operable.

The actuator also comprises a shaft cap screw which provides a means for bleeding air from the chamber after initial installation. An actuator compression spring, functioning as the lower biasing means, is disposed above the cap screw in order to compensate for slight wear of the segments. Its spring rate is always greater than the spring rate of the poppet compression spring, functioning as the upper biasing means, which presses the poppet disc against the valve seat. The actuator compression spring also provides an additional reservoir of water at the closed end of the chamber, beneath the bottom segment.

The combined spring rates of the actuator compression spring and of the poppet compression spring are not sufficient to dislodge the latch balls from the cylindrical detent groove. However, after freezing within the chamber has expanded the spaces between the sensing balls, while locking the actuator compression spring in an ice prison, the topmost ball pushes against the bottom of the actuator rod with irresistible force until the latch balls are forced over the lower cam shoulder of the detent groove onto the descending slope of the frusto-conical cam, whereby the latch compression springs and the poppet compression spring lift the poppet disc into firm engagement with the valve seat of the supply port in the water supply valve to the building being protected from water damage during the subsequent thaw. With assistance from line water pressure, this supply port remains closed until the lever arm is manually and selectively operated against the top of the poppet stem.

The segments of the expansion sensing means also function as an incremental sealing means because formation of ice initially occurs at the bottom of the chamber and along the interior surface of the housing (i.e., the wall of the chamber) and then between the wall and the periphery of each segment before freezing of water and resultant expansion occurs within the interior of the chamber, progressively moving between the segments from the closed end of the chamber toward the valve.

The fluid in the chamber may be water, an aqueous solution, or any other liquid which expands when changing from its liquid state to its solid state. The valve body, the latch housing, and the piping on each side of the valve for a short distance must be insulated. In addition, the piping on each side of the valve must be of sufficiently thin and stretchable material that freezing expansion within the valve and within the piping can be absorbed by stretching thereof in order to avoid damage to the valve body. Hose, plastic pipe, hard copper tubing, and soft copper tubing are satisfactory materials.

The disclosure of U.S. Pat. No. 4,784,173 is hereby fully incorporated herein by reference.

Valves made by the Lunkenheimer Co., P.O. Box 145487, Cincinnati, Ohio 45214 and by the S. C. Kingston Co., 1007 N. Main St., Los Angeles, Calif. 90012, are suitable for water and aqueous solution control in the freeze guard valve of this invention.

DESCRIPTION OF THE PREFERRED EMBODIMENTS

Figure 1:
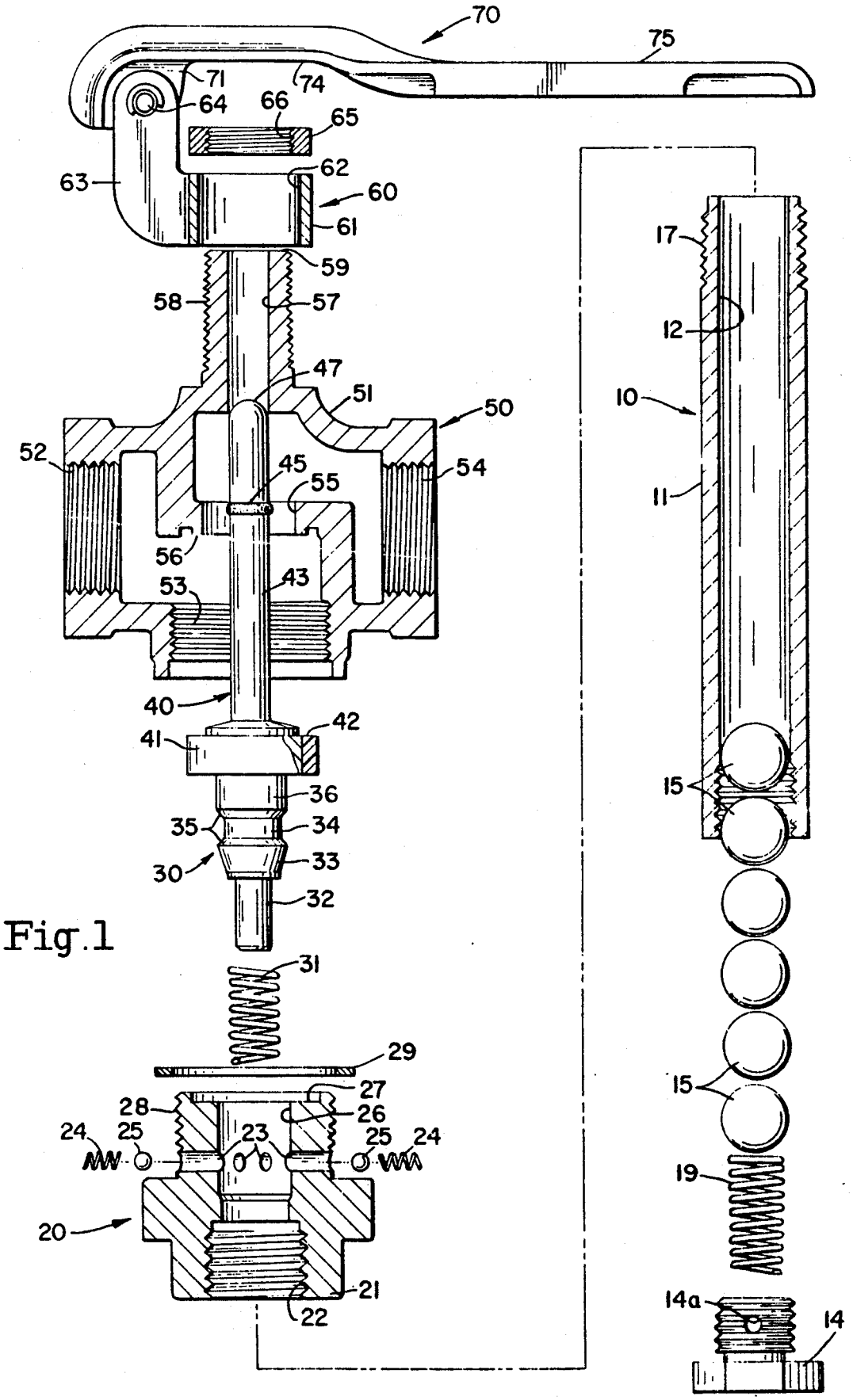
FIG. 1 is an exploded sectional elevation of a complete freeze guard valve of this invention
Figure 2:
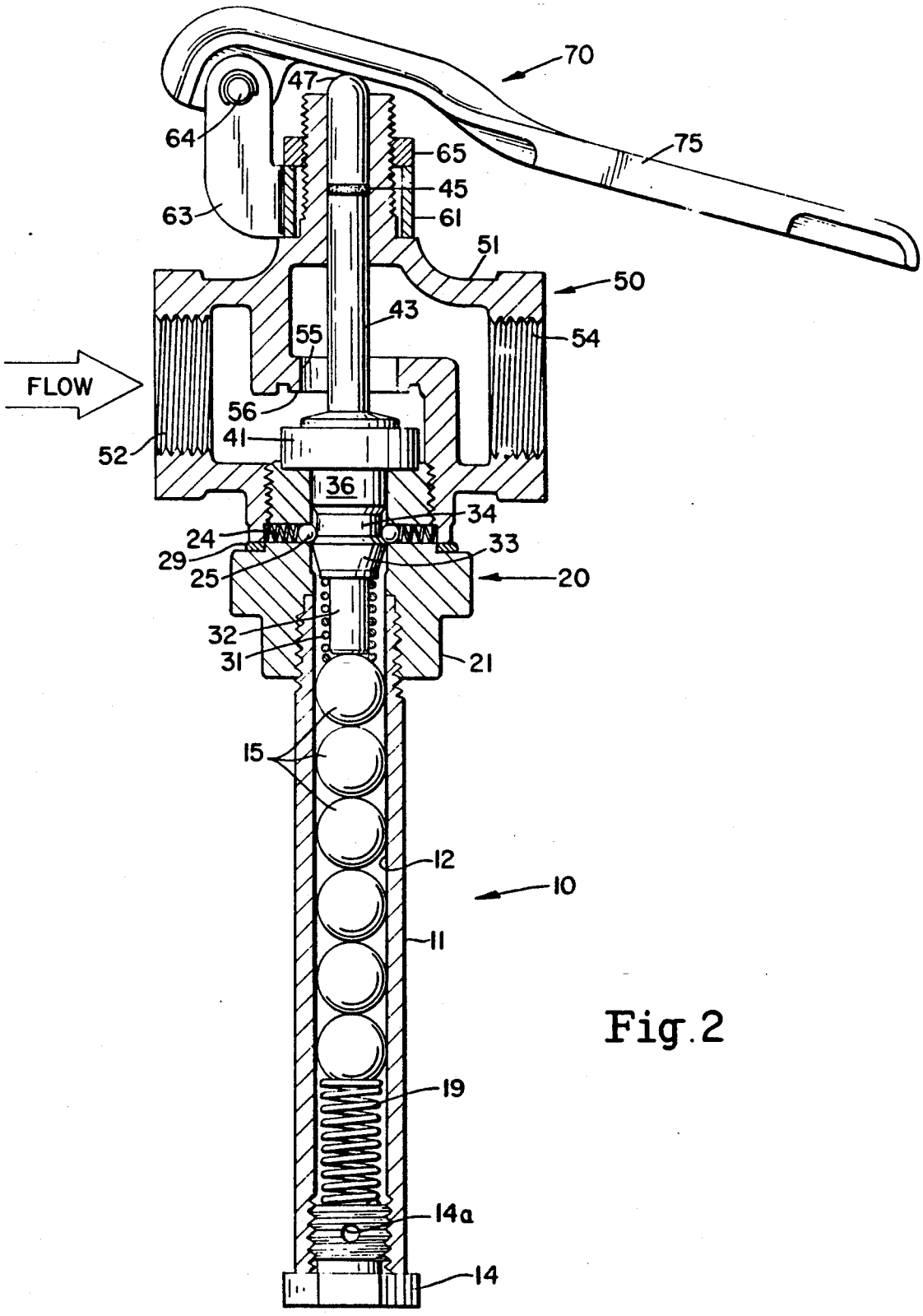
FIG. 2 is a sectional elevation of a complete freeze guard valve of this invention, in its open position with water in its chamber.
Figure 3:
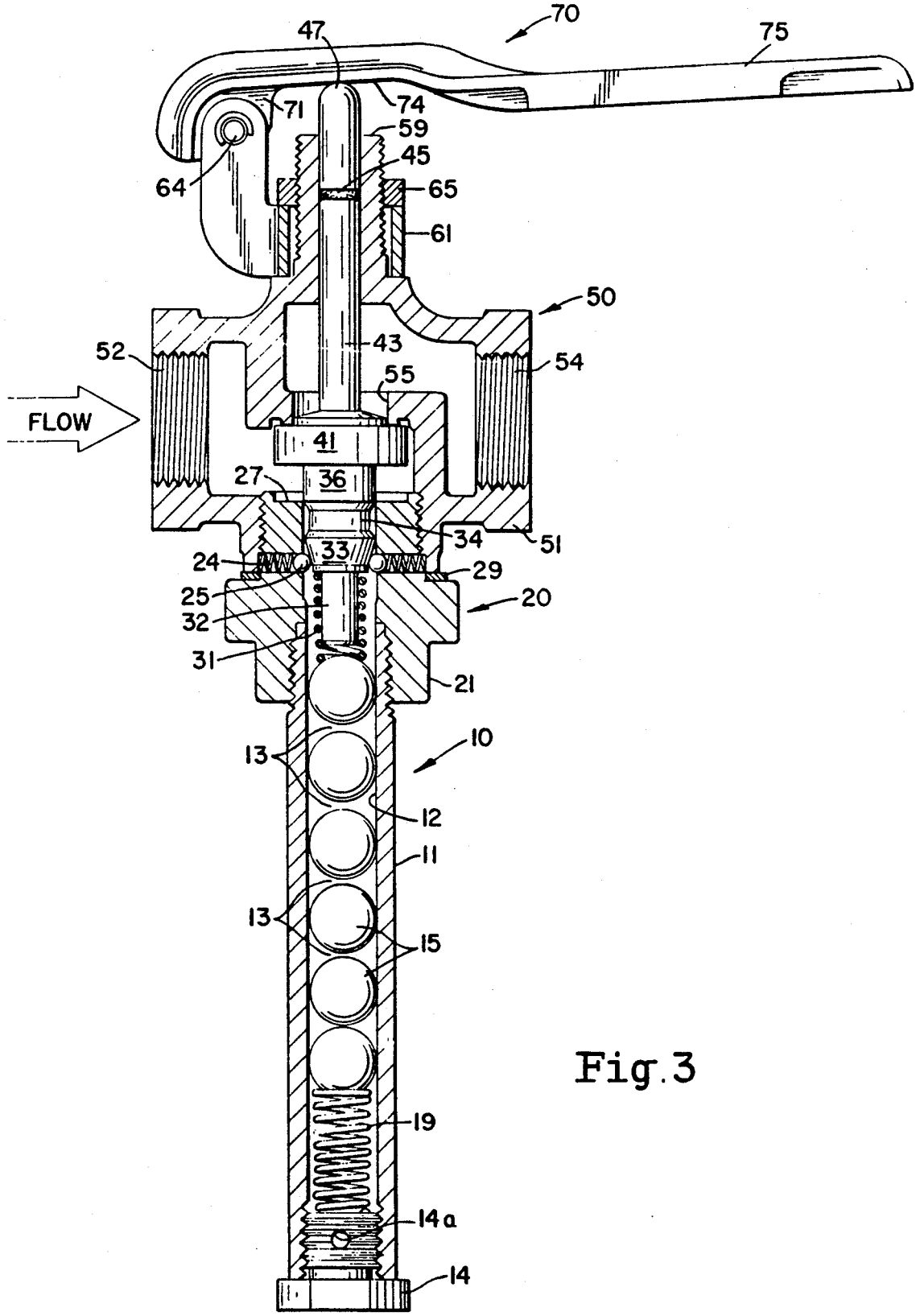
FIG. 3 is another sectional elevation, similar to FIG. 2, in which the poppet disc has been urged into sealing engagement with the supply port of the valve.

The operational freeze guard valve shown in FIGS. 1, 2, and 3 comprises actuator assembly 10, latch housing assembly 20, poppet latchpin assembly 30, poppet disc assembly 40, valve 50, lug arm assembly 60, and lever arm 70. Actuator assembly 10 is rigidly aligned with poppet latchpin assembly 30 which is rigidly attached to, and axially aligned with, poppet disc assembly 40. Actuator assembly 10 is also rigidly aligned with, and attached to, latch housing assembly 20 which is attached to valve 50.

Actuator assembly 10 comprises a cylindrical actuator housing 11 having inner surface 12 which defines the actuator chamber, actuator or sensing balls 15 which are disposed within the chamber, spaces 13 between the balls within which ice may form, actuator cap 14 with bleed bores **14*a* which is threadably attached to the lower end of housing 11, male threads 17 at the upper end of housing 11, and actuator compression spring 19**.

Latch housing assembly 20 comprises latch housing 21, female threads 22 at its lower end for reception of threads 17, radially aligned bores 23 which are peripherally and equally spaced apart, compression springs 24 which are disposed within bores 23, latch balls 25 at the inner ends of springs 24, inner surface 26 of housing 21, undercut 27 that eliminates hitting of housing 21 by poppet disc 41 when the valve is open, male threads 28, and soft copper gasket 29.

Poppet latchpin assembly 30 comprises poppet compression spring 31, actuator rod 32 which fits within spring 31, frusto-conical cam 33, detent groove 34, cam shoulders 35 which are at about 45° to the surface and on each side of detent groove 34, and guide rod 36.

Poppet disc assembly 40 comprises poppet disc 41 having deformable surface 42, stem 43 which is rigidly attached to disc 41, o-ring 45, and stem top 47.

Valve 50 comprises valve body 51, inlet port 52, actuator port 53, outlet port 54, supply port 55 having circular seat 56, a top port or stem bore having inner surface 57 and external threads 58, and top 59. Ports 52, 53, and 54 have internal or female threads.

When the water in housing 11 freezes into ice, forcing actuator balls 15 apart to form spaces 13 therebetween so that latch balls 25 are forced over lower cam shoulder 35 and down onto cam 33, springs 24 urge poppet disc assembly 40 upwardly in combination with spring 31 until poppet disc 41 is moved the additional distance upwardly that is needed to put deformable surface 42 in firm contact with circular seat 56 of supply port 55.

The surface of guide rod 36 engages inner surface 26 of latch housing 21 while the surface of stem 43 engages the inner surface 57 of the stem bore, whereby poppet latchpin assembly 30 and poppet disc assembly 40 are maintained in axial alignment with valve body 51.

Unlike many devices of the prior art, failure of o-ring 45 can not prevent the freeze guard device of this invention from operating properly. Indeed, any leakage of water past o-ring 45 can be easily visible in warm weather or in freezing weather.

Lug arm assembly 60 comprises cap 62 which fits movably around top port 57, bifurcated lug arm 63 which is rigidly attached to cap 62, pin 64, and nut 65, having internal threads 66 which threadably engage external threads 58. Nut 65 is tightened sufficiently to hold lug arm assembly 60 rigidly in place.

Lever arm 70 comprises pivoting portion 71 which has a hole into which pin 64 fits, pressure portion 74 which is selectively pressed against stem top 47 after freezing weather and a thaw have occurred, and handle portion 75.

EXAMPLE 1

Figure 4:
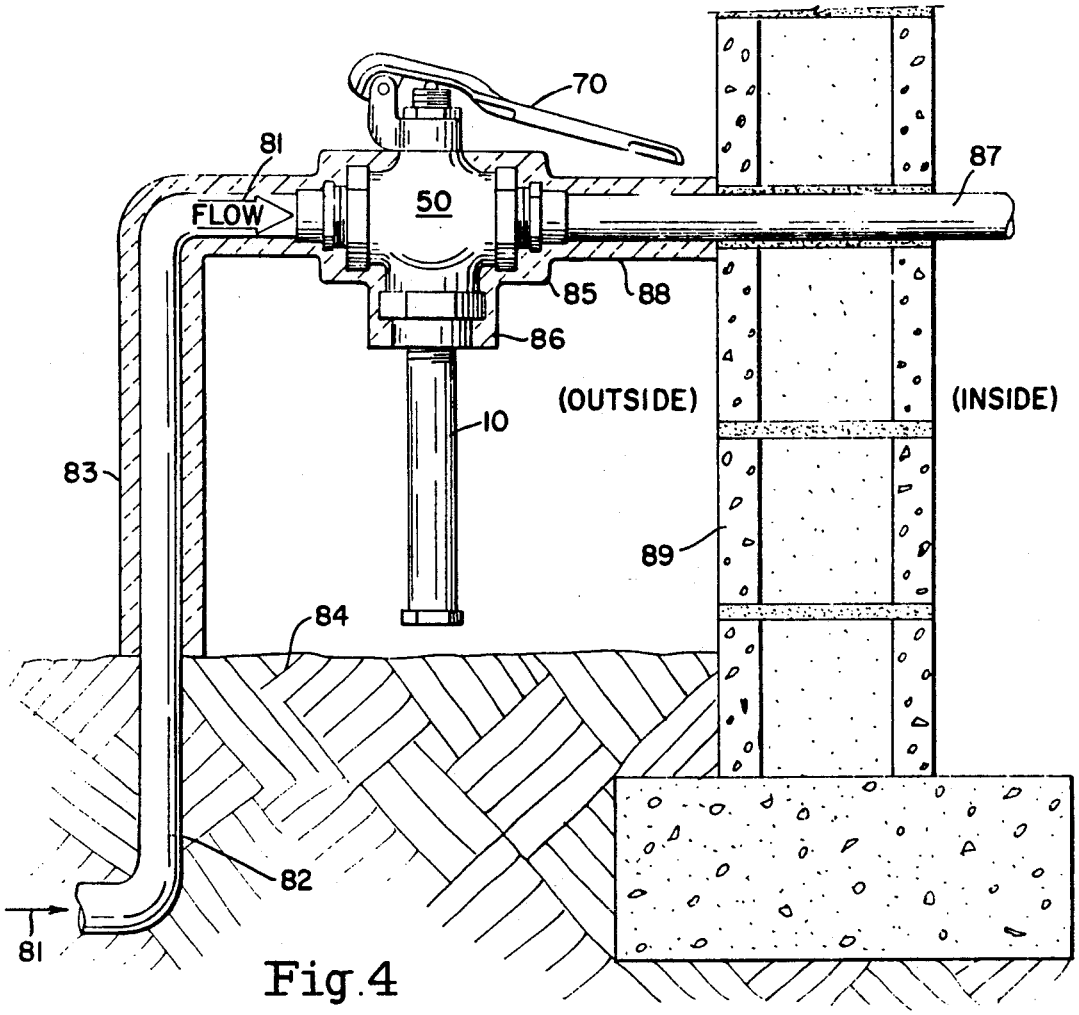
FIG. 4 is a sectional elevation showing a typical installation of the freeze guard valve of the invention in a water line entering a building structure above grade in a moderate climate that experiences an occasional freeze.

A typical installation for moderate climates that experience an occasional freeze is shown in FIG. 4. Water supply line 82 emerges from ground 84, and freeze guard valve 50 is attached thereto so that it is exposed to ambient conditions. Outlet pipe 87, threadably attached to threads 54 of valve 50, enters building structure 89 above grade. Inlet pipe 82 is covered with insulation 83, valve 50 is covered with insulation 85, the latch housing is covered with insulation 86, and outlet pipe 87 is covered with insulation 88. When freezing conditions occur, water flow 81 is stopped as balls 15 within actuator assembly 10 are forced apart, bringing poppet disc 41 against valve seat 56 and thereby closing valve 50.

EXAMPLE 2

Figure 5:
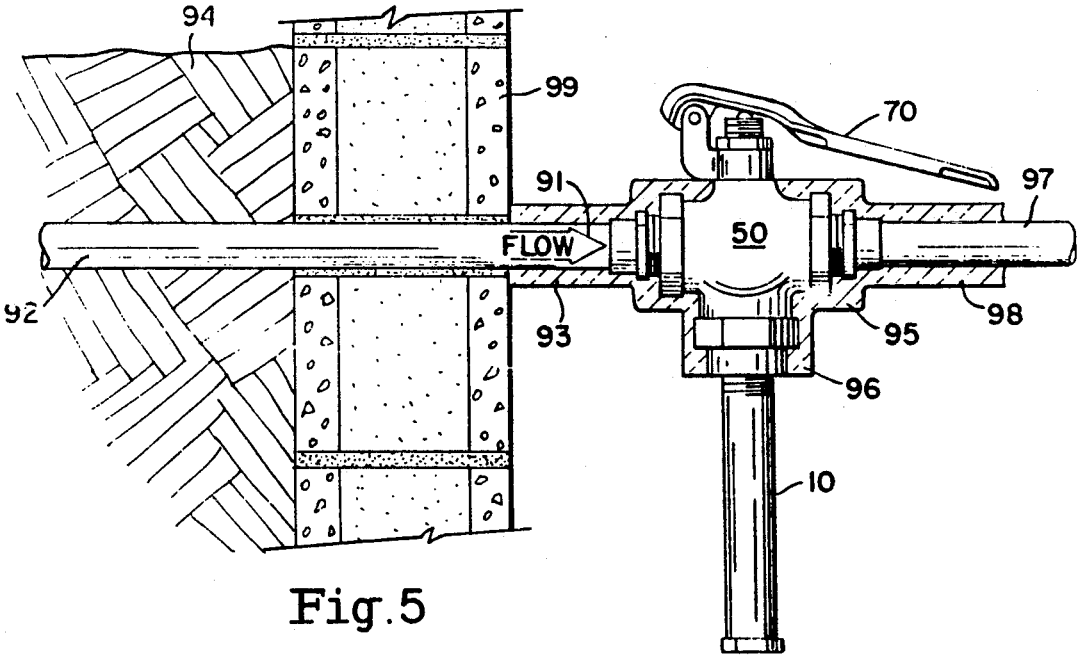
FIG. 5 is a sectional elevation showing a typical installation of the freeze guard valve of the invention in a water line entering a building structure below grade.

A typical installation wherein the water supply line enters the building structure below grade is shown in FIG. 5. Water flow 91 moves through water supply pipe 92 which is embedded in ground 94, passes through building structure 99, and is threadably attached to valve 50. The exposed portion of pipe 92 is covered with insulation 93. Freeze guard valve 50 is covered with insulation 95, and the latch housing is covered with insulation 96. Outlet pipe 97 is similarly covered with insulation 98 for a short distance along the pipe, such as approximately six inches.

EXAMPLE 3

Figure 6:
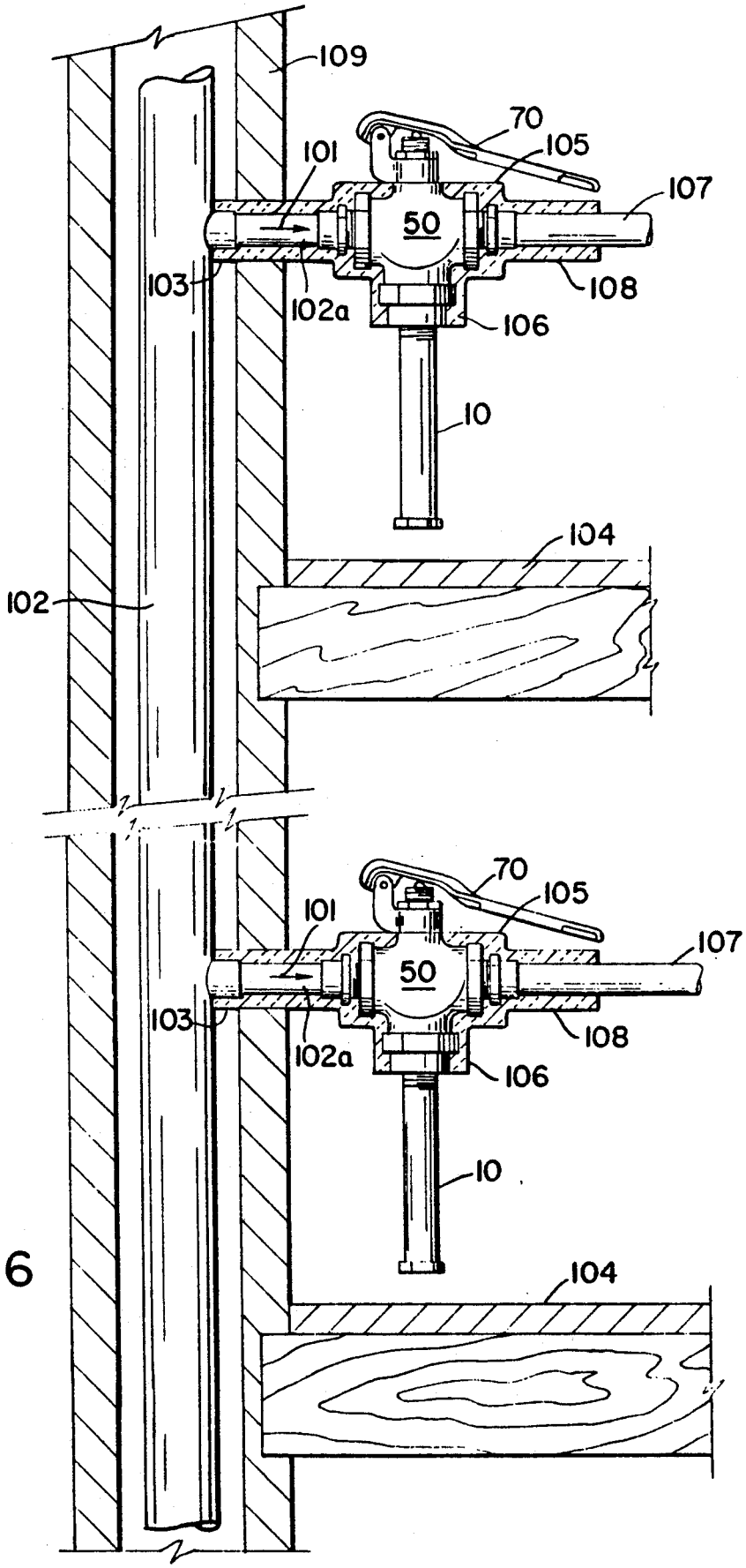
FIG. 6 is a sectional elevation showing a typical installation of two freeze guard valves of the invention in water lines in two locations and at two levels of a building structure.

Another typical installation for a multi-unit, multi-level building structure is shown in FIG. 6. Water main 102 is within building structure 109 having floors 104, and inlet water supply pipes **102*a* are connected to it and to two freeze guard valves 50. Water outlet pipes 107 are connected to valves 50. Inlet pipes 102*a* are covered with insulation 103, valves 50 are covered with insulation 105, the latch housing is covered with insulation 106, and water outlet pipes 107 are covered with insulation 108 for a short distance. Water flows 101 are stopped when valves 50** are actuated by freezing conditions.

EXAMPLE 4

Figure 7:
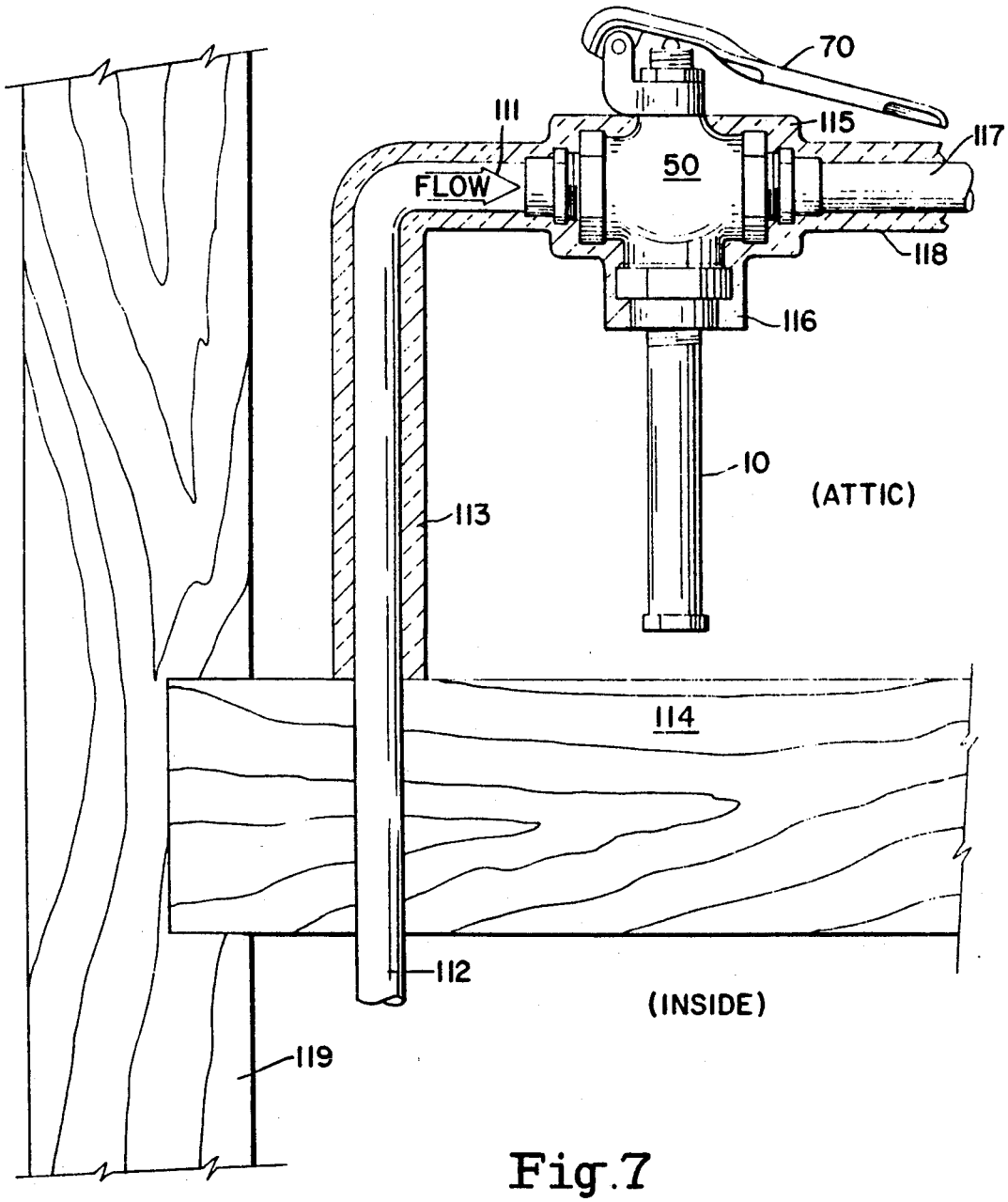
FIG. 7 is a sectional elevation showing a typical installation of a freeze guard valve of the invention in a water line entering an attic or any space of a building structure that is subject to freezing temperatures earlier than the interior of the structure.

An additional typical installation is shown in FIG. 7 in which a water supply line enters an attic or any other space within a building structure that might be subjected to cooler temperatures than other portions of the interior of the structure, whereby the line in the attic may freeze before the lines in the other interior portions. A water supply line 112 passes through ceiling 114, which is attached to building wall 119, and is covered with insulation 113 until it is connected to freeze guard valve 50 which is covered with insulation 115, the latch housing being covered with insulation 116. Outlet pipe 117 is covered with insulation 118 for a short distance. Water flow 111 is stopped when valve 50 is actuated by freezing conditions in the attic.

EXAMPLE 5

Figure 8:
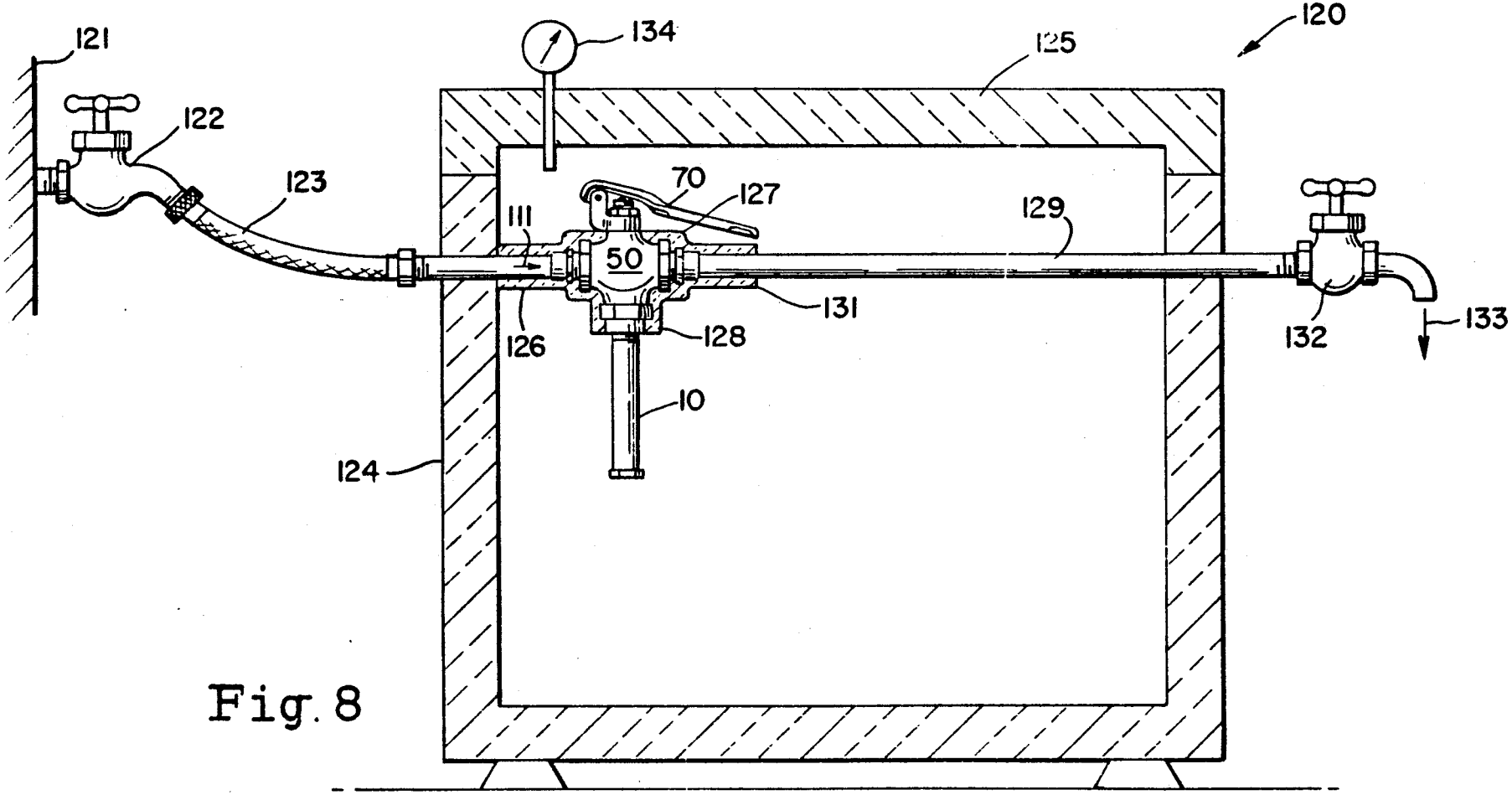
FIG. 8 is a sectional elevation of a test facility for a freeze guard valve of the invention.

To test the freeze guard valve of this invention, the test facility shown in FIG. 8 was utilized. Pipe 123 was attached to a water faucet 122 on a water line emerging from a wall 121. Pipe 123 was then passed through a side 124 of a freezer 120 and connected to a freeze guard valve 50 of this invention. An outlet pipe 129 was connected to valve 50 and passed through the other side of freezer 120. A close-off faucet 132 was attached to line 129. In various freezing tests, the freeze guard valve was actuated within 5 hours at −10° F. to 2 hours at −50° F.

EXAMPLE 6

In the initial test, no insulation was installed on the valve body or on adjacent piping. With the freezer in operation, the water in the inlet and outlet pipes froze before all of the water froze in actuator 10. Water flow 133 was stopped, but freezing of the water trapped in valve 50 cracked the valve body.

EXAMPLE 7

Valve 50 was covered with insulation 127, and the latch housing was covered with insulation 128. When tested at freezing temperatures, the water froze first in actuator 10 and in the uninsulated pipes 123 and 129, causing flow 133 to stop. However, it was found that allowing valve 50 to remain in freezer 120 nevertheless resulted in freezing of the water trapped within valve 50 and cracking of the valve body.

EXAMPLE 8

Pipes 123, 129 were then covered, respectively, with insulations 126, 131, and the freezing test was repeated. The test was successful, but it was again found that allowing valve 50 to remain sufficiently long, such as overnight, within freezer 120 resulted in freezing of the water trapped within valve 50 and cracking of the valve body.

EXAMPLE 9

Pipe 123 was replaced with hose 123, as indicated in FIG. 8, and pipe 129 was replaced with soft copper tubing. Freezing tests then demostrated that these stretchable piping materials allowed freezing expansion within valve 50 to be absorbed by stretching thereof. Another test demonstrated that hard copper tubing was also satisfactory. It was concluded that the valve body, the latch housing, and the adjacent piping should be insulated for a short distance on either side of the valve and, in addition, hard or soft copper tubing or plastic pipe should be installed for short distances adjacent to the valve and on each side of it in order to absorb freeze expansion within the valve.

Because it will be readily apparent to those skilled in the art of freeze damage limitation that innumerable variations, modifications, applications, and extensions of the principles hereinbefore set forth can be made without departing from the spirit and the scope of the invention, what is hereby defined as such scope and is desired to be protected should be measured, and the invention should be limited, only by the following claims.

What is claimed is:

1. A water freeze guard valve that utilizes the volumetric expansion of water as the sole source of power for closing said valve which is line-connected to a water supply system, said valve comprising a valve seat through which water flows from said water supply system, a waterfilled and elongated actuation chamber which contains an expansion sensing means and is disposed approximately vertically, a linkage means, which comprises a detent groove and a poppet disc and extends into said chamber and is operably connected to said expansion sensing means, for transmitting said expansion to said poppet disc when water in said chamber begins to freeze, a latch means for maintaining said poppet disc spaced apart from said valve seat during normal operation of said water supply system, whereby flow of water from said water supply system is unimpeded, a biasing means for forcing said poppet disc into sealing contact with said valve seat when freezing of said water in said chamber occurs and forces said latch means out of said detent groove, whereby said flow through said valve seat is stopped, and a lever means for selectively re-setting said latch means after said freezing and said subsequent thaw have occurred in order to re-set said poppet disc to a normal, open position.

2. The water freeze guard valve of claim 1, wherein said valve further comprises a cam means for preventing re-setting of said linkage means when a thaw occurs after a freeze has caused said valve to close.

3. The water freeze guard valve of claim 1, wherein said valve is connected on inflow and outflow sides thereof to stretchable piping materials.

4. The water freeze guard valve of claim 3, wherein said materials comprise hose, hard copper tubing, soft copper tubing, and plastic pipe.

5. The water freeze guard valve of claim 2, wherein said valve further comprises a lever arm for manually re-setting said latch means after said freeze and said subsequent thaw have occurred.

6. A water freeze guard valve that is flow connected to a water supply system and that, when exposed to a freezing ambient environment, utilizes the longitudinally directed volumetric expansion of water, while it freezes in a water-filled actuation chamber which is elongated, disposed approximately vertically, and operably connected to said valve, as its sole source of power for closing said valve, comprising:

A. a valve body having a water inlet, a water outlet, a valve port surrounded by a valve seat, a poppet disc seating and unseating against said valve seat, an actuator port, and a stem bore;

B. an actuator housing, which encloses said actuation chamber, having a closed end, an open end which is connected to said actuator port, and a central axis, said chamber being filled with water and in flow communication with said valve port;

C. at least one segment of an expansion sensing means which is disposed within said chamber;

D an actuating linkage means, that extends from one end of said poppet disc and into said chamber, for axially transmitting movement of said expansion sensing means to said poppet disc and for engaging said valve seat when said freezing initially forms a seal between said housing and said at least one segment and then causes the distance between said segment and said closed end to increase;

E. a latch means, disposed adjacent to said actuation chamber, and a latch groove means, disposed on said linkage means, for maintaining, in combination, said poppet disc spaced apart from said valve seat to permit fluid flow from said water inlet to said water outlet during normal operation of said water supply system;

F. a biasing means for maintaining said poppet disc in contact with said valve seat after freezing has occurred within said chamber and during a subsequent thaw; and G. a lever means fo selectively actuating said latch means after said freezing and said subsequent thaw have occurred to re-set said poppet disc to a normal, open position.

7. The freeze guard valve of claim 6, wherein said segments are balls which fit closely but movably within said chamber.

8. The freeze guard valve of claim 7, wherein said balls, said linkage means, and said biasing means are formed from stainless steel.

9. The water freeze guard valve of claim 6, wherein said water inlet and said water outlet are connected to stretchable piping materials.

10. The water freeze guard valve of claim 9, wherein said stretchable materials comprise hose, plastic pipe, hard copper tubing, and soft copper tubing.

11. A water freeze guard valve, connected to a water supply system for a building and having a valve body and a supply port, for protecting the interior of said building from water damage during a thaw after freezing weather, by utilizing the longitudinally directed expansion of water accompanying ice formation in said freezing weather to close said supply port, comprising:

A. a vertically disposed, elongated actuator housing which encloses a chamber containing a means, at the freezing point of water, for sensing the expansion of water stored in said chamber to form ice;

B. a linkage means for transmitting said expansion upwardly toward said water freeze guard valve, comprising a poppet latchpin which comprises:

1) an actuator rod which extends into said chamber, 2) a frustoconical cam which is rigidly attached to the upper end of said actuator rod, 3) a cylindrical detent groove which is rigidly attached to said cam, 4) a guide rod which is rigidly attached to said groove, 5) a poppet disc which is rigidly attached to said guide rod, and 6) a poppet stem which is rigidly attached at its lower end to said poppet disc;

C. a latch means, disposed adjacent to said chamber, for maintaining said poppet disc, in combination with said detent groove, at a selected distance below said supply port while said water remains in its liquid state, said latch means becoming inoperable when said expansion occurs;

D. an upper biasing means for forcing said poppet disc upwardly into sealing engagement with a valve seat surrounding said supply port;

E. a top port at the top of said water freeze guard valve which is in axial alignment with said housing and within which said poppet stem is movably disposed; and F. a lever means which is adapted to be selectively pressed against the upper end of said poppet stem after freezing and thawing of said water have occurred, whereby said latch means is again operable and said poppet disc is restored to an latched, operable position.

12. The water freeze guard valve of claim 11, where in said expansion sensing means comprises a plurality of segments which incrementally form a plurality of ice seals with the interior surface of said housing and sense the expansion of said water within said chamber and between said segments.

13. The water freeze guard valve of claim 12, wherein said segments are metal balls.

14. The water freeze guard valve of claim 12 which further comprises a lower biasing means for compressing said sensing means against said latchpin.

15. The water freeze guard valve of claim 12, wherein said poppet latchpin additionally comprises:

A. an actuator rod which is axially aligned with said actuator housing and is in firm contact at one end with the surface of the uppermost of said segments;

B. a frusto-conical cam which is axially aligned with and attached to said actuator rod;

C. a cylindrical detent groove which is attached to said cam; and

D. a poppet cylindrical guide rod which is attached to said detent groove and to said poppet disc.

16. The water freeze guard valve of claim 15, wherein a latch housing surrounds said actutor rod, said frusto-conical cam, said detent groove, and said guide rod and comprises:

A. a plurality of radially disposed bores which are equally space and radially arranged and disposed to be aligned with said cylindrical detent groove when said supply port is open;

B. a plurality of latch compression springs which are disposed within said bores;

C. a plurality of latch balls which are disposed at the inward ends of said latch springs; and D. a cylindrical portion which is disposed to engage said cylindrical guide rod.

17. The water freeze guard valve of claim 11, wherein said lever means comprises:

A. a lug arm and an attached collar which surrounds said top port;

B. a fastening nut which is threadably attached to said top port and rigidly engages said collar; and C. a lever arm which is pivotally attached to said lug arm.

18. The water freeze guard valve of claim 11, wherein said valve is connected on each side to stretchable piping materials that are capable of absorbing the volumetric expansion of water within said valve.

19. The water freeze guard valve of claim 17, wherein said materials comprise hose, plastic pipe, hard copper tubing, and soft copper tubing.

* * * * *